United States Patent [19]

Scheinecker et al.

[11] 4,018,261

[45] Apr. 19, 1977

[54] CONTINUOUS CASTING PLANT STRAND GUIDING MEANS

[75] Inventors: Alois Scheinecker, Linz; Franz Kagerhuber, Traun, both of Austria

[73] Assignee: Vereinigte Osterreichlsche Eisen- und Stahlwerke-Alpine Montan Aktiengesellschaft, Linz, Austria

[22] Filed: May 12, 1976

[21] Appl. No.: 685,545

[30] Foreign Application Priority Data

May 13, 1975 Austria ..... 3625/75

[52] U.S. Cl. ..... 164/282

[51] Int. Cl.[2] ..... B22D 11/128

[58] Field of Search ..... 164/282, 82

[56] References Cited

UNITED STATES PATENTS

| | | | |
|---|---|---|---|
| 3,319,699 | 5/1967 | Olsson | 164/282 |
| 3,550,675 | 12/1970 | Hess et al. | 164/282 |
| 3,710,847 | 1/1973 | Schoffmann | 164/282 |
| 3,730,256 | 5/1973 | Reinfeld et al. | 164/282 |
| 3,752,219 | 8/1973 | Burkhardt et al. | 164/282 |
| 3,891,025 | 6/1975 | Bolbig et al. | 164/282 X |

FOREIGN PATENTS OR APPLICATIONS

| | | | |
|---|---|---|---|
| 45-1042 | 4/1967 | Japan | 164/282 |

*Primary Examiner*—Ronald J. Shore
*Attorney, Agent, or Firm*—Brumbaugh, Graves, Donohue & Raymond

[57] ABSTRACT

A strand guiding means for a continuous casting plant with sets of supporting rollers and also driving rollers. At least one driving roller being arranged at the beginning and/or at the end of a set of supporting rollers. The driving rollers are mounted on cross beams, which are in turn connected to one of two supporting roller carrying members, preferably by means of a linkage parallelogram. In addition the driving rollers are displaceable perpendicularly to the strand surface.

11 Claims, 6 Drawing Figures

CONTINUOUS CASTING PLANT STRAND GUIDING MEANS

BACKGROUND OF THE INVENTION

The invention relates to a strand guiding means to be used in a continuous casting plant for supporting, guiding and extracting the cast strand or a starter bar. The strand guiding means is provided with sets of supporting rollers arranged one behind the other in the direction of extraction of the strand. Each set of supporting rollers is provided with a number of rollers located opposite each other and carried by respective roller carrying members also arranged opposite each other, which members are adapted to be adjusted and fixed perpendicular to the surface of the strand. The strand or the starter bar is guided between the respective rollers attached to these members and between the driving rollers provided along the strand guiding means. The driving rollers are adjustable to the strand or the starter bar.

Driving rollers that are adapted to be driven and adjusted to the starter bar and which are arranged between supporting rollers that are merely adjustable to the dimensions of the cross section of the cast strand, prevent an intermittent extraction of the cast strand at the beginning of casting when a wedge-shaped starter bar head tapering in the advancing direction of the strand is used, thus avoiding damage to the cast strand.

In German Auslegeschrift No. 1,758,533 a strand guiding means with drivable pressure rollers adjustable to the smallest cross section of a variety of starter bar heads is described. These pressure rollers are mounted in separate stands, i.e. stands separate from the stands of the supporting rollers. The pressure forces acting upon the pressure rollers are relieved adjacent a pressure roller as soon as the starter bar head of the starter bar approaches such pressure roller and the respective pressure roller is adjusted to the size of the cast strand. All of the roller running surfaces facing the strand must be in precise alignment, so as to avoid any unnecessary deformation of the strand and thus an increased extraction force or even cracks in the strand skin. A disadvantage of the construction described in German Auslegeschrift No. 1,758,533 consists in that it is difficult to carry out a precise adjustment to the thickness of the cast strand of the pressure rollers mounted in separate stands and independent of the supporting rollers. A further disadvantage is seen in that any change in the strand thickness necessitates a re-adjustment of not only the position of the supporting rollers, but also the position of the pressure rollers.

SUMMARY OF THE INVENTION

The present invention has as its object to eliminate these disadvantages and difficulties and aims at providing a strand guiding means of the above defined kind in which the running surfaces of the driving rollers that are adjustable to the starter bar can easily and reliably be adjusted to the thickness of the cast strand and in precise alignment with the running surfaces of the supporting rollers. Such an adjustment is also retained in the event of a readjustment of the distance between the supporting rollers for the purpose of having the machine adjusted for a different strand thickness. Therefore a separate adjustment of the driving rollers to the strand thickness is not required and the resetting can be carried out within a minimum of time.

This object is achieved in accordance with the present invention by mounting the driving rollers, each arranged at the beginning and/or at the end of a set of supporting rollers, on cross beams which are connected to one of the roller carrying members by parallel motion means, preferably by means of a linkage parallelogram, and which are movable perpendicularly to the strand surface. Each of the cross beams is adjustable by means of at least one pressure medium cylinder, or the like, either directly or via a lever linkage. Thus, the adjustable driving rollers form a unit with the supporting rollers, so that it is only necessary to get the individual sets of supporting rollers in alignment relative to each other without having to additionally adjust the interposed adjustable driving rollers to the position of the supporting rollers.

Advantageously, the parallel motion means is secured to the inner or upper supporting roller carrying members.

Suitably, the length of the links or the length of the levers of the linkage parallelogram is adjustable. This that serves the purpose of allowing the adjustable driving rollers arranged closely adjacent the supporting rollers to be adjusted without the supporting rollers interfering with the pivotability of the movable driving rollers.

According to a further preferred embodiment, a pressure limiting valve is associated with the pressure medium cylinder, the pressure of the valve being so adjusted that the force transmitted from the cylinder to the driving roller is less than the ferrostatic pressure of the strand in the respective area. This pressure limiting means makes it possible to adjust the driving rollers not only to the starter bar with a pressure sufficient to still reliably guarantee a smooth, i.e. not intermittent, extraction thereof, but also to the cast strand itself, so as to apply an extraction force thereto without damaging the cast strand. It is, thus, no longer necessary to relieve the pressure force applied onto the driving rollers shortly before the starter bar head passes therethrough.

Advantageously, a supporting plate is guided on the cross beam so as to be displaceable in the direction of the driving roller axis. A hydraulic motor driving the driving roller is flanged to the supporting plate so as to be in alignment with the driving roller.

Moreover, an adjustable stop may be secured to the roller carrying member for limiting the movement of the cross beam. This stop may be resilient and under an adjustable pre-stress.

BRIEF DESCRIPTION OF THE DRAWINGS

The invention shall now be described, by way of example only, with reference to two embodiments as shown in the accompanying drawings, in which.

DESCRIPTION OF EXEMPLARY EMBODIMENTS

Figure 1:
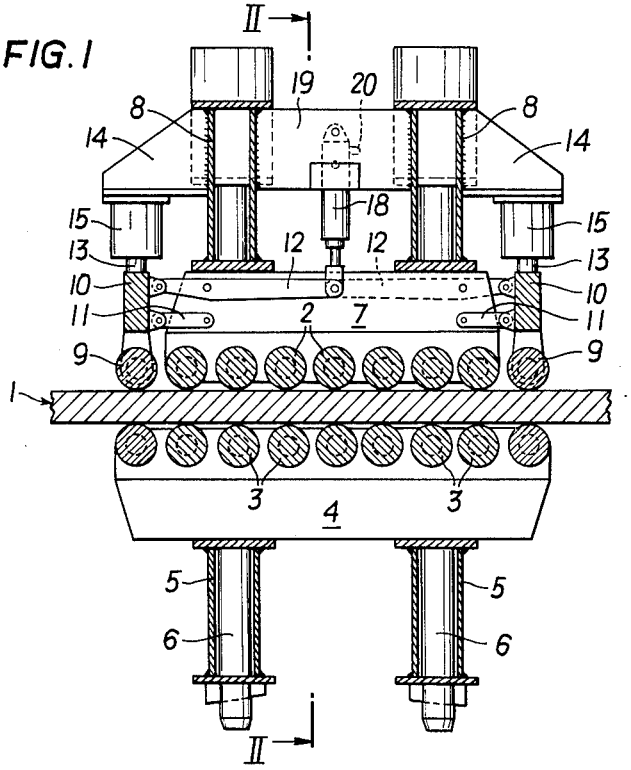
FIG. 1 shows a section, perpendicular to the axes of the supporting rollers, through a set of supporting rollers according to one embodiment of the invention.
Figure 2:
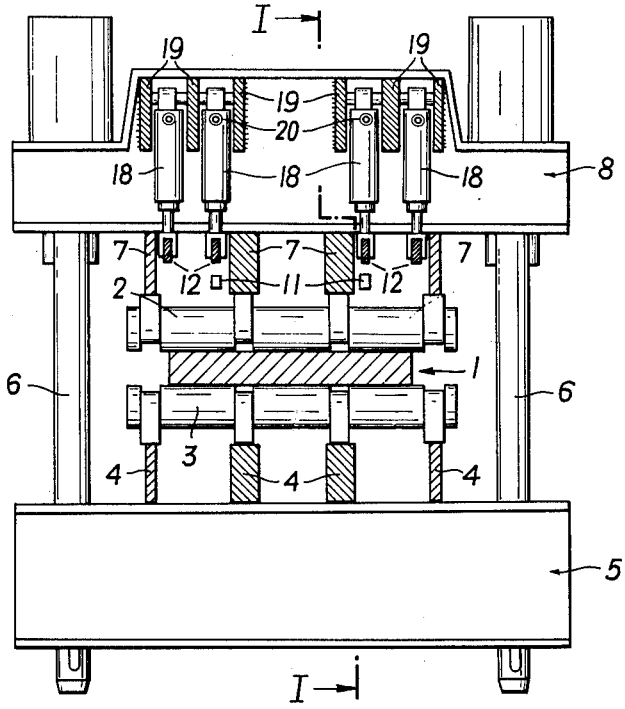
FIG. 2 shows a section along line II—II of FIG. 1.

In FIGS. 1 and 2, 1 denotes a cast strand which is extracted from a mould, not shown, and is guided between supporting rollers 2 and 3 mounted as a set. Similar sets of supporting rollers can be arranged on one behind the other in the extraction direction of the strand. Each set of supporting rollers is comprised of two strand parts 5 secured to the base, in which stand parts the supporting rollers 3 are mounted via longitudinal carriers 4. Opposite the stand parts 5 there are stand parts 8 arranged on the strand arc innerside or strand arc upperside, which stand parts 8 support the supporting rollers 2, arranged on the inner side of the strand opposite the supporting rollers 3, via longitudinal carriers 7. Each pair of stand parts (5 and 8) which are arranged opposite each other are fixedly secured to each other, by two drawing anchors 6. An adjustment to different strand thicknesses is carried out in a known manner by displacing the stand parts 8 along the drawing anchors 6 until the desired strand thickness has been adjusted, whereupon the stand parts are resecured on the drawing anchors.

The longitudinal carriers 4 project beyond the two ends of the longitudinal carriers 7 by one supporting roller each. Opposite these outermost supporting rollers mounted on the longitudinal carriers 4, driving rollers 9 are provided, which driving rollers are mounted on a cross beam 10. These cross beams 10 are hinged to the longitudinal carriers 7 by means of a linkage parallelogram comprising wings 11 and 12, so that the cross beams are movable relative to the strand surface. Height-adjustable stops 13, arranged on both sides at the ends of each cross beam 10 and secured to the stand parts 8 via consoles 14, limit the movement of the cross beams in a direction away from the strand surface. With the help of these adjustable stops, the driving rollers can be adjusted in their position relative to the supporting rollers, even if any finishing defects or fabrication inaccuracies should be present, so that once the cross beams get in touch with the stops the distance between the driving rollers and their counterpart supporting rollers is equal to the distance defined by opposing supporting rollers 2 and 3. The stops are made resilient by means of pressure medium cylinders 15. These pressure medium cylinders 15 are under an adjustable pre-stress, so that the stops can yield whenever the driving rollers are unduly loaded by the strand, while they do not yield when the driving rollers are solely exposed to the ferrostatic pressure of the strand. The stop, being under prestress, yields as soon as the load on the driving rollers caused by the cast strand exceeds the counteracting prestress force of the stop and the adjusting force applied by the adjusting means and acting upon the driving rollers. Thus, the driving rollers are protected from being overloaded. It is also possible to employ, instead of the pressure medium cylinders 15, springs that are under an adjustable prestress, such as cup springs.

Figure 6:
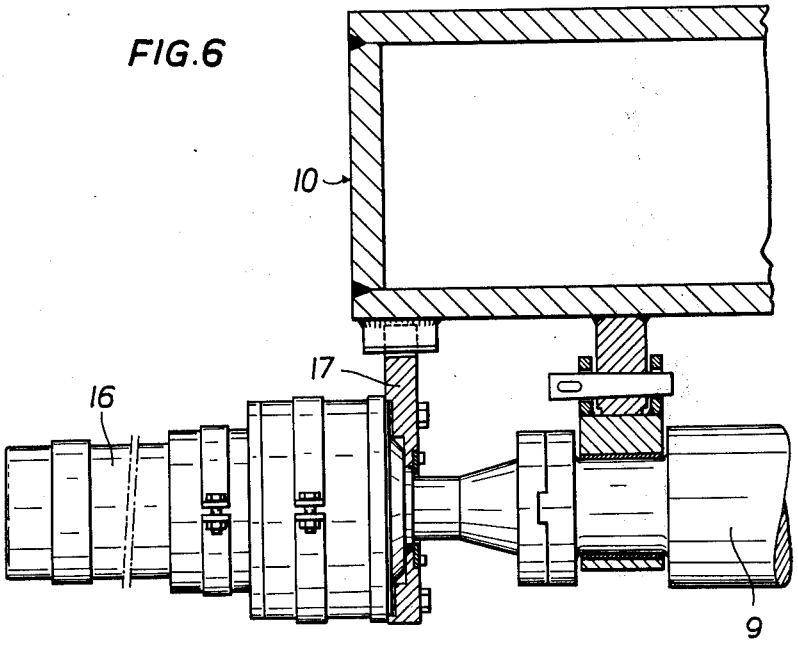
FIG. 6 shows the arrangement of a slip-on hydraulic motor on a driving roller.

On one end of each cross beam a hydraulic motor 16 slipped onto each driving roller is supported via a torque support 17 (FIG. 6).

Movement of the cross beams is effected by pressure medium cylinders 18, whose piston rods are each hinged to a wing 12 elongated in the direction toward the pressure medium cylinder. The pressure medium cylinders are articulately connected with beams 19 welded in between the stand parts 8. A pressure limiting valve 20 assures that the driving rollers are pressed onto the strand with only such a pressure as is reliably less than the ferrostatic pressure inherent in the respective slab size. Thus, the pressure force is independent of the respective position of the driving roller. It is thereby assured that the driving rollers 9 are in true alignment with the supporting rollers 2 during casting, since, due to the ferrostatic pressure of the cast strand, the cross beams 10 are pressed as far as to the stops 13.

If the cast strand to be transported shrinks or if the cold strand is to be conveyed, the driving rollers 9 follow the surface of the strand with a pressure limited by the pressure limiting valve 20. Thus, an extraction force of the magnitude of the pressure force multiplied by the respective friction value of the starter bar or the cast strand is guaranteed.

Figure 3:
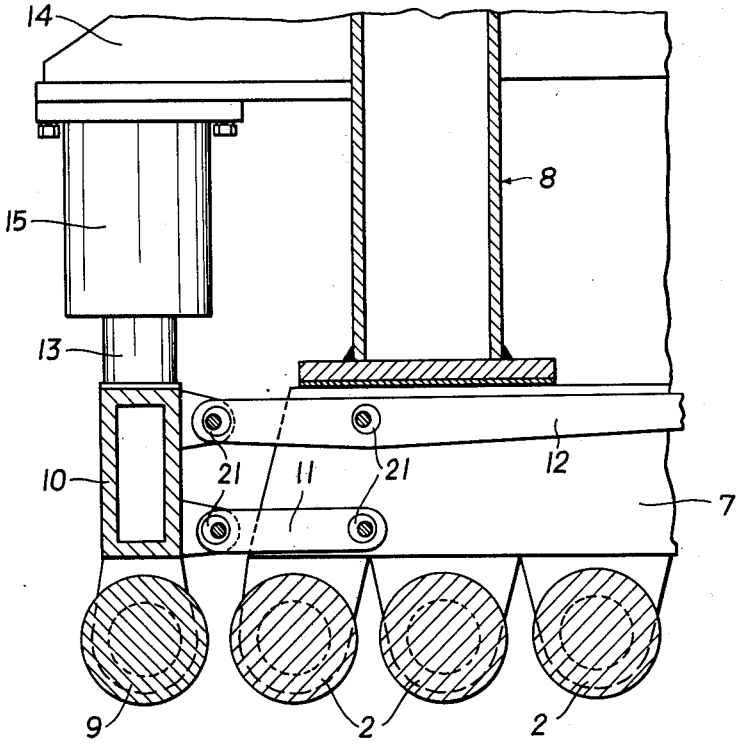
FIG. 3 shows a detail of FIG. 1 on an enlarged scale.

The bearings of the wings 11 and 12 are adjustable by means of eccentric bushings 21 (FIG. 3) both on the cross beams 10 and on the longitudinal beams 7. These bushings assure that an exact parallel guiding of the driving rollers can be obtained, even if possible finishing defects should be present, and also that the axes of the driving rollers do not take a lopsided or skew position relative to the axes of the supporting rollers. A longitudinal displacement of the wings can also be achieved by wings designed as turnbuckles.

Figure 4:
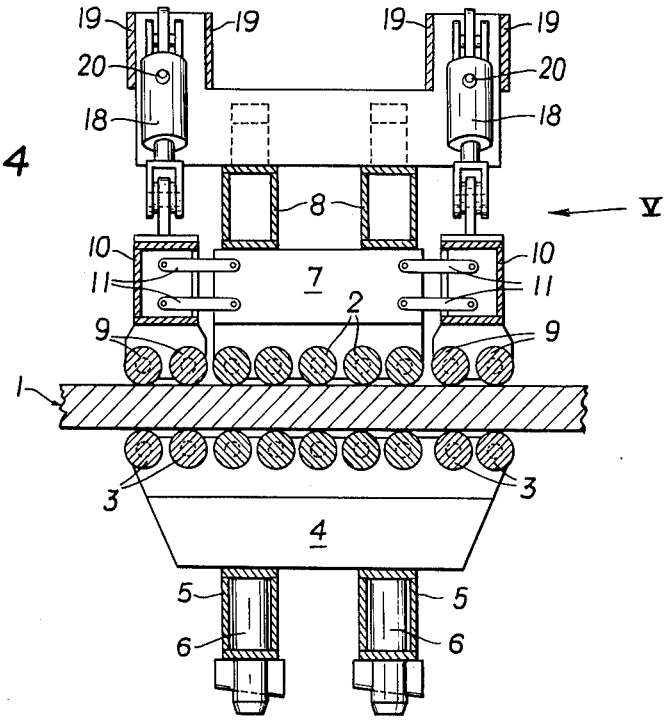
FIG. 4 shows a section, analogous to FIG. 1, with another embodiment of the invention.
Figure 5:
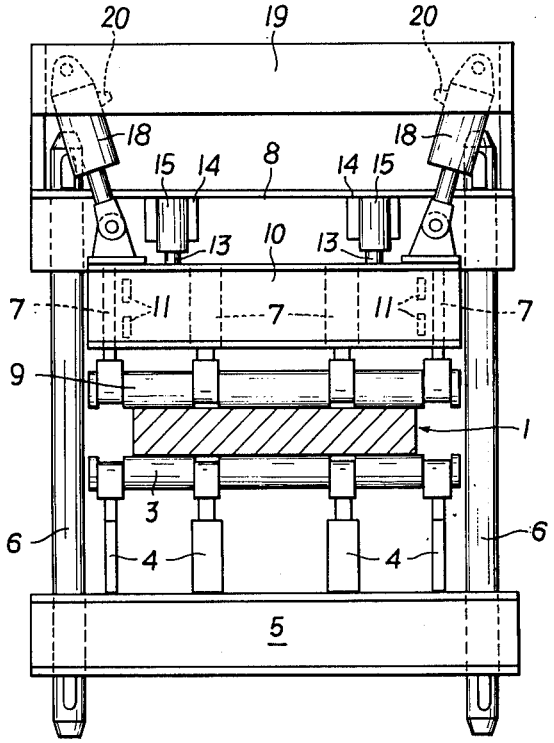
FIG. 5 is a view in the direction of the arrow V in FIG. 4.

In FIGS. 4 and 5, another embodiment of the strand guiding means of the present invention is illustrated, in which parts corresponding in their functions to parts already described are denoted with the same numerals. What is different in this embodiment is the arrangement of the pressure medium cylinders 18, which directly actuate the cross beams 10, and the arrangement of two driving rollers 9 on each of the cross beams 10.

It will be appreciated that various further embodiments of the strand guiding means of the invention are possible, thus, for instance, it is possible in the case of only a minor extraction force being required to arrange the adjustable driving rollers on one end of each set of supporting rollers only, whereby a strand guiding means composed of such sets of supporting rollers will have only half as many adjustable driving rollers. Similarly, a strand guiding means would be possible that is composed of alternating sets of supporting rollers with driving rollers and without such driving rollers. In this manner the number of driving rollers can easily be adapted to the individual requirements of the respective continuous casting machine and identically designed sets of supporting rollers can be used. Thereby, a simple exchangeability of the machine parts is guaranteed and there is a savings in the cost and the room required for keeping a stock of spare parts.

We claim:

1. A continuous casting plant strand guiding means for supporting, guiding and extracting a cast strand or a starter bar, which comprises:

sets of supporting rollers arranged one behind the other in the extraction direction of the strand, each set of supporting rollers including a number of rollers located opposite each other and carried by respective upper and lower roller carrying members also arranged opposite each other, which members are adjustable perpendicular to the strand surface and fixable, the strand or the starter bar being guided between the respective supporting rollers of the upper and lower carrying members;

a plurality of driving rollers, at least one driving roller being arranged at at least one end of a set of supporting rollers;

cross beams movable perpendicularly to the strand surface, each cross beam carrying at least one driving roller;

parallel motion means connecting each cross beam to a roller carrying member; and pressure medium cylinder means for adjusting the cross beams.

2. A strand guiding means as set forth in claim 1, wherein at least one driving roller is arranged at the upstream end and at the downstream end of a set of supporting rollers.

3. A strand guiding means as set forth in claim 1, wherein the parallel motion means is a linkage parallelogram.

4. A strand guiding means as set forth in claim 1, wherein each cross beam is adjustable by pressure medium cylinder means via a lever linkage.

5. A strand guiding means as set forth in claim 4, wherein the lever linkage is length-adjustable.

6. A strand guiding means as set forth in claim 1, wherein the parallel motion means are secured to the upper roller carrying members.

7. A strand guiding means as set forth in claim 1, wherein the parallel motion means have length-adjustable links.

8. A strand guiding means as set forth in claim 1, wherein a pressure limiting valve is associated with each pressure medium cylinder means, the pressure limit of said valve being adjusted so that the force transmitted from the cylinder means to the driving roller is less than the ferrostatic pressure of the strand in the respective range.

9. A strand guiding means as set forth in claim 1, further comprising a supporting plate guided on each cross beam so as to be displaceable in the direction of the driving roller axis and a hydraulic motor flanged to said supporting plate so as to be in alignment with said driving roller and to drive said driving roller.

10. A strand guiding means as set forth in claim 1, wherein an adjustable stop is secured to the roller carrying member for limiting the movement of the cross beam connected thereto.

11. A strand guiding means as set forth in claim 10, wherein the stop is resilient and under an adjustable pre-stress.

* * * * *